United States Patent [19]

Janssen et al.

[11] Patent Number: 4,548,121

[45] Date of Patent: Oct. 22, 1985

[54] BREECH MECHANISM WITH A MUSHROOM HEAD PACKING

[75] Inventors: Karl-Egon Janssen, Meerbusch; Heinz G. Breür, Duisburg, both of Fed. Rep. of Germany

[73] Assignee: Rheinmetall GmbH, Duesseldorf, Fed. Rep. of Germany

[21] Appl. No.: 560,801

[22] Filed: Dec. 13, 1983

[30] Foreign Application Priority Data

Dec. 23, 1982 [DE] Fed. Rep. of Germany ..... 3247744

[51] Int. Cl.[4] ..... F41F 11/02

[52] U.S. Cl. ..... 89/26

[58] Field of Search ..... 89/22, 23, 26, 17, 24, 89/25

[56] References Cited

U.S. PATENT DOCUMENTS 2,800,057 7/1957 Hoopes ..... 89/28.05
3,707,900 1/1973 Hornfeck et al. ..... 89/26
4,308,785 1/1982 Samuel ..... 89/26

FOREIGN PATENT DOCUMENTS 15309 of 1911 United Kingdom ..... 89/26
885361 12/1961 United Kingdom ..... 89/24

*Primary Examiner*—Charles T. Jordan
*Assistant Examiner*—Ted L. Parr

[57] ABSTRACT

A breech mechanism having a breech block and an obturator for an automatic weapon for firing with a high firing frequency and high gas pressure without inhibiting the safety of the weapon against jamming or misfiring.

The obturator is pivotally mounted about a first axis which is normal with respect to the longitudinal axis of the gun barrel to pivot about an axis of 90° from a closed firing position to an open loading position and vice-versa. A pair of control cams are operatively connected via a pair of projecting pins to said obturator in said breech aperture. The breech block has a pair of laterally projecting pins which are adapted to slidingly guide the control cams during their pivotal movement. A pair of biasing members are pivotally connected at one of their ends to opposite walls of the breech aperture and at their other ends to the pair of control cams so as to bias the obturator either into the closed firing position or the open loading position.

5 Claims, 7 Drawing Figures

BREECH MECHANISM WITH A MUSHROOM HEAD PACKING

BACKGROUND OF THE INVENTION

A breech mechanism having a mushroom shaped obturator is, for example, disclosed in U.S. Pat. No. 4,308,785. In this known arrangement a slidable breech block is controlled via a pivotally mounted lever during the recoil movement of the gun barrel. In this known arrangement a mushroom-head obturator is moved via guide rollers disposed in the breech block, first in the direction of the gun barrel axis away from the end of the gun barrel rear end and then transversely with respect to the first movement. For purposes of closing the rear end of the gun barrel the movement is in the opposite direction. The breech block is first moved laterally away from the gun barrel axis in order to permit the afore-described stepwise movement of the mushroom-head.

German Pat. No. 1,870,778 also discloses a wedge-shaped breech block mechanism, the breech block of which is controlled by the recoil of the gun barrel. Also in this case the mushroomhead obturator must, in order to open the breech, be slidably moved axially away from the gun barrel end. Thereafter this wedge-shaped breech block is moved transversely with respect to the gun barrel axis. In order to achieve this bidirectional motion, a skewed toothed pinion is mounted on the mushroom-head support and a skewed toothed gear rack is mounted on the breech block. These known breech mechanisms are constructionally complex; they require at all times a two-step operation. This in turn inhibits the safety of the arrangement with respect to misfiring or jamming. Consequently, these known arrangements have a limited firing cadence capability and are found to be unsuitable when very high gas pressures are used.

SUMMARY OF THE INVENTION

It is therefore an object of this invention to provide a breech mechanism with a mushroom-head obturator which is particularly suitable for use with a highly elastic maintenancefree mushroom-head obturator, which is simple in construction, so that it may be used in an automatic gun, having a high firing cadence and operating with a high gas pressure, without inhibiting the safety of the weapon with respect to jamming or misfiring. The breech mechanism of this invention can be used with all types of flat-wedge-breech blocks, without requiring a fundamental change in the operation of the breech block mechanism itself.

BRIEF DESCRIPTION OF THE DRAWING

With these and other objects in view, which will become apparent in the following detailed description, the present invention, which is shown by example only, will be clearly understood in connection with the accompanying drawing, in which:

FIG. 5 is a front elevational view of the guide 3 and sealing mushroom support member 4*a.

DETAILED DESCRIPTION

Figure 1A:
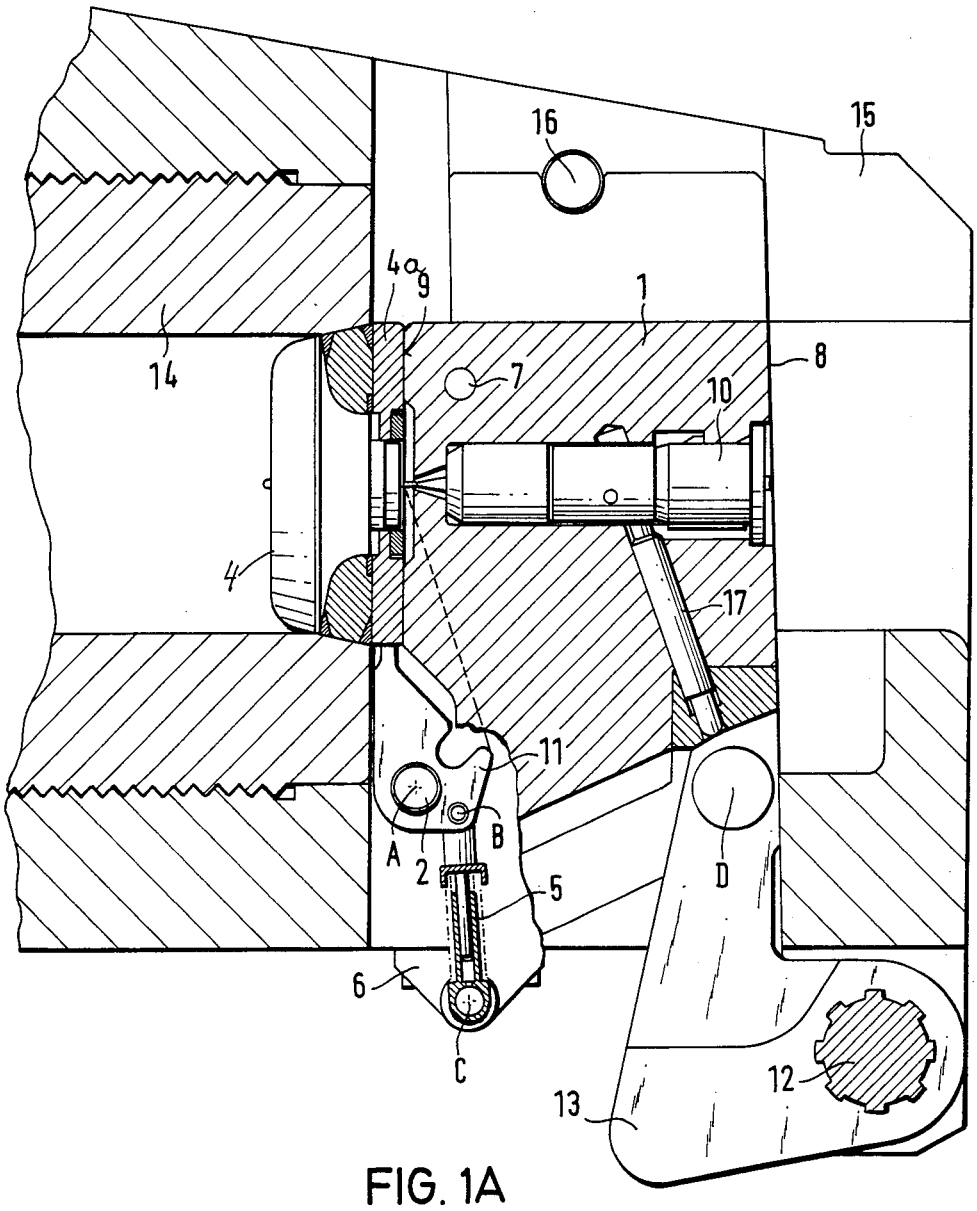
FIG. 1A is a longitudinal cross-sectional view of the breech mechanism of this invention shown in a closed and locked position.

Parts of the breech block are depicted in FIG. 1A, in a position wherein the breech block closes the rear end of the gun bore 14 and which is also the firing position. The same parts are shown in an open operative position, which is the loading position in FIG. 1B.

Figure 1B:
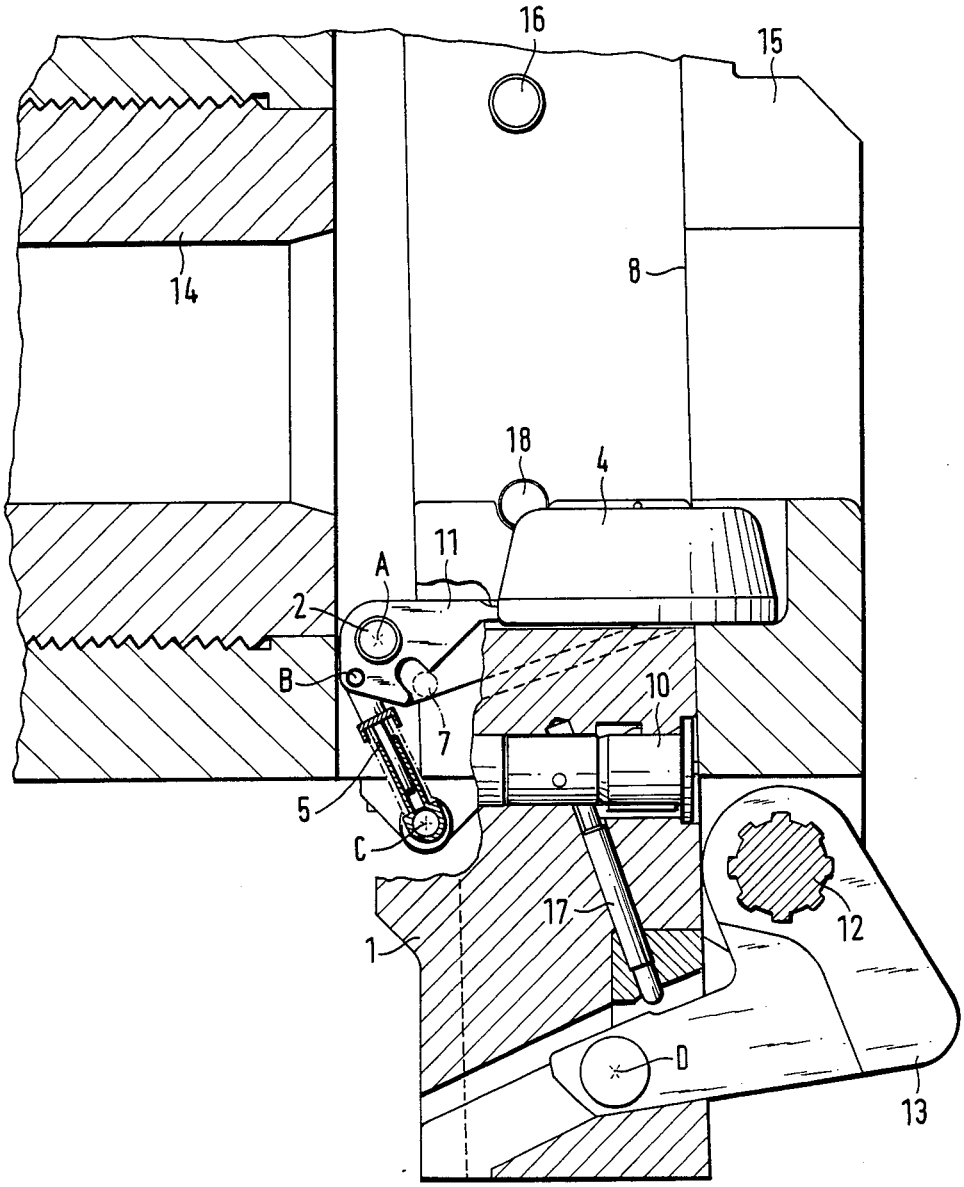
FIG. 1B is a cross-sectional longitudinal view of the breech mechanism of this invention in an unblocked and open position.
Figure 2:
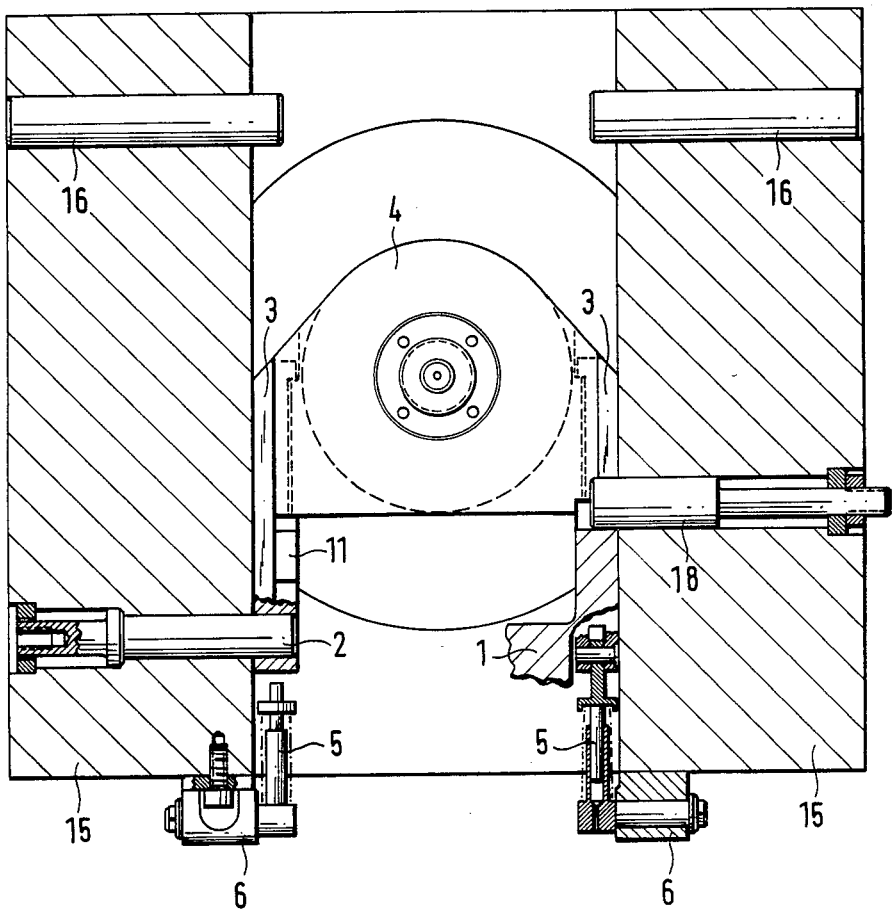
FIG. 2 is an end cross-sectional and elevational view through the breech mechanism of the invention showing the mushroom-head in the closed position of FIG. 1A.
Figure 3:
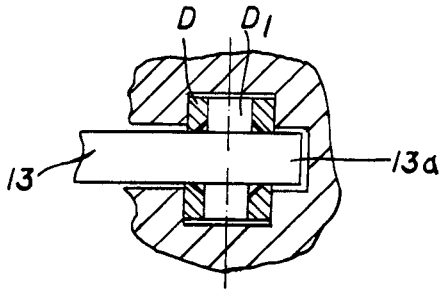
FIG. 3 is a constructional detail shown in cross-section of the lever 13 engaging into groove D1.
Figure 4:
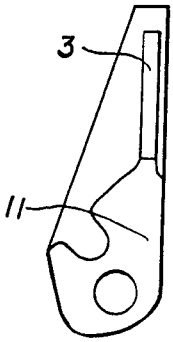
FIG. 4 is a side elevational view of the guide 3.
Figure 5:
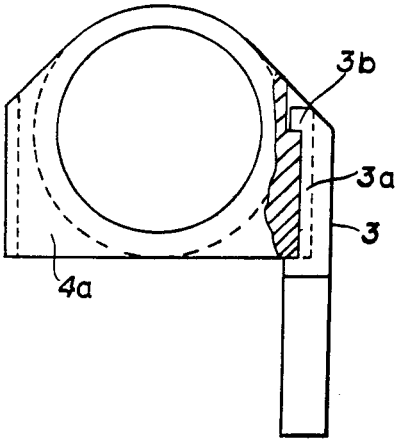
Figure 5A:
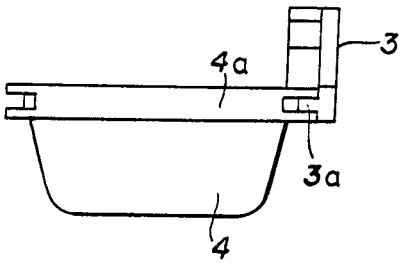
* and FIG. 5A is a top plan view of the guide 3 and sealing member 4.

In FIG. 1A the wedge-type breech block 1 is slidably mounted along the skewed wedge surface 8 of the bottom member 15. There is also mounted in the bottom member 15 in a known manner the shaft 12 on which the lever 13 for opening the mechanism fixedly is mounted. A roller D bilaterally extends from the lever 13 and projects into the guide groove D1 of the breech block (FIG. 3). During its closing motion the lever 13 presses with its free end the pin 17, which is spring biased to extend into the groove D1, into the breech block. The mushroom-seal 4 which closes the loading chamber (se FIG. 1A) is pivotally mounted via the guides 3 on the control bolts 2. The connection between the mushroom support member 4*a* and the guides 3 can be effected in several ways. For example a projection 3*b* of the guide 3 can engage into a mating recess of the mushroom support member 4*a*. The mushroom head 4 and support member 4*a* can be easily and removably mounted on the pair of guides 3 between the two halves of the bottom member 15 as depicted in FIG. 2. The guides 3 are formed on their inner sides as control cams 11. The pivot shaft can be pivoted about an angle of 120°. This lever 13 engages via a pivot roller D, disposed at its opposite end, into the guide groove D1 of the wedge-type breech block 1 and pushes the control bolt 17 out of the guide groove D1 as it slides past it. The bolt 17 is scewedly mounted in the wedge-type breech block 1 and slightly projects into the guide groove D1 when in its inoperative position. The actuation of the bolt 17 by the roller D is conventional and is described, for example, in U.S. Pat. No. 2,800,057. The mushroom-seal 4, which seals the gun barrel bore 14, is joined via the guides 3 (see FIG. 2) with the control bolts 2. The control bolts 2 are mounted on the bottom member 15 as depicted in FIG. 2, in which only one bolt 2 is shown. The control cams 11, which are integral with the guides 3, are arranged on the control bolts 2 as shown in FIGS. 1A and 1B. A pressure spring rod 5 is pivotally connected via the pivot connection B on each control cam 11 at one end and is pivotally connected at the other end via a pivot connection C in a bracket 6, which in turn is connected to the bottom member 15 (only a portion of the left rod 5 is illustrated in FIG. 2 while the right rod of FIG. 2 is shown in cross-section). The wedge-type breech block 1 abuts with its bearing surface 9 against that portion of the mushroom seal 4 which projects from the rear end of the gun barrel 14 and pre-compresses it. In the breech position the contact plane of the firing arrangement 10, which is actuated via the opening lever 13 and control bolt 17, establishes electrical contact between the wedge-type breech block 1 and the sealing mushroom 4. The wedge-type breech block 1 has a laterally arranged pin 7 disposed in a bore which comes into operative contact with the control cam 11. In the closed position the wedge-type breech block 1 is held and maintained in this closed position via the positioning pins 16 which engage in mating indentations of the wedge-type breech block 1. The same wedge-type breech block 1 receives, as is illustrated in FIG. 1A the firing arrangement 10 in a mating bore.

MANNER OF OPERATION

In order to expose the loading chamber, the wedge-type breech block 1 is moved downwardly in a known manner by means of the shaft 12 and the opening lever 13. This causes the control bolt 17 to be released and the firing contact between the wedgetype breech block 1 and the sealing mushroom 4 to be interrupted. During this wedge-type breech block movement there is first of all released the pre-pressure of the sealing mushroom 4 acting on the end of gun barrel bore 14 in view of the scewed sliding surface 8 which has an inclination of approximately 1°. A further downward movement of the wedge-type breech block 1 causes the pins 7 to impact on the corresponding control cams 11. This causes these control cams 11 to rotate in a clockwise direction and to thereby pivot the sealing mushroom 4 laterally away from the rear end of the gun barrel bore 14 about 90° into a recess of the wedge-type breech block 1 and the bottom member 15, as is illustrated in FIG. 1B. As soon, as a result of this swinging motion, the pivot point A of the control cam 11 and the pivot points B and C of the spring pressure rod 5 are positioned in one plane in which the dead point for the pressure spring is reached, the pressure spring rods transfer, at a further rotation, the previously described closing effect into an opening effect. The sealing mushroom 4 thereby swings, while bearing against the wedge-type breech block 1, into the position illustrated in FIG. 1B. In this latter position a locking, for example by means of a spring-biased bolt 18, mounted in the bottom member 15, which engages in a recess of the wedge-type breech block 1, is effected. The closing of the wedge-type breech block 1 with the sealing mushroom 4 is effected in the reverse order, after the aforedescribed locking has been released. In an upwards slidable movement of the wedge-type breech block 1 the pins 7 first engage from below the edge of the control cam 11, until the points A, B and C are again disposed in one plane, whereinafter the pressure force of the skewed pressure spring rods 5 at rotation of the control cam 11 to the left transforms a right-pivoting moment into a left-pivoting moment, so that a closing effect of the sealing mushroom 4 is achieved, whereby it is returns into the position illustrated in FIG. 1A.

During the downward movement of the breech block 1 the pins 7 abut from above on the leading edge of the control cam 11 and rotate it. During the upward movement the pins 7 abut from below (as seen in FIG. 1B) against the leading edge of the control cams 11 and pivot to the left so that the mushroom seal is pivoted up to the gun barrel end. When the breech block is in its uppermost position it abuts with its recess against the pins 16. These pins 16 therefore limit the upward movement of the breech block 1; no actual locking of the breech block 1 occurs.

Although the invention is described and illustrated with reference to a preferred embodiment thereof, it is to be expressly understood that it is in no way limited to the disclosure of such preferred embodiment but is capable of numerous modifications within the scope of the appended claims.

We claim:

1. An improved breech mechanism for a gun barrel, having a breech aperture defined by a bottom member and a breech block which is operatively movable transversely with respect to the gun barrel axis, and and obturator which is controlled by the movement of the breech block, the improvement comprising, said obturator being pivotally mounted about a first axis which is normal to the longitudinal axis of the gun barrel and is pivotable over an angle of 90° to move from a closed firing position to an open loading position and vice-versa;

a pair 16 control cams being pivotally mounted at opposite sides of the breech aperture about second and third axes which are normal to the longitudinal axis of the gun barrel;

said breech block having a pair of laterally projecting first pins which are adapted to slidingly guide the pair of control cams during their pivotal movement;

a pair of biasing members being respectively pivotally connected at one of their ends to opposite walls of said breech aperture and at their other ends to said control cams so as to bis said obturator either into said closed firing position or said open leading position.

2. The improvement in a breech mechanism as set forth in claim 1, wherein said obturator is operatively connected to said pair of control cams via a pair of projecting pins which slidingly engage in a pair of guide slots of said obturator.

3. The improvement in a breech mechanism as set forth in claim 2, wherein said breech block is wedge-shaped and has a rear surface which is skewed, said rear surface is adapted to slide along a skewed surface of said breech aperture, said breech block also has a front surface which is adapted to bear against said obturator and press it against the rear end of the gun barrel when said breech block is in the closed position.

4. The improvement in a breech mechanism as set forth in claim 3, wherein when said first, second and third axes are positioned in alignment by means of a pivotal movement of said biasing members and said control cams, said biasing members change their bias on said control cams from a left turning moment to a right turning moment.

5. The improvement in a breech mechanism as set forth in claim 4, including locking means operatively mounted in said bottom member and extending into said breech aperture to selectively block upward transverse movement of said breech block.

* * * * *